US007174869B2

(12) United States Patent
Proschko et al.

(10) Patent No.: US 7,174,869 B2
(45) Date of Patent: Feb. 13, 2007

(54) SWITCHABLE FINGER LEVER OF A VALVE TRAIN OF AN INTERNAL COMBUSTION ENGINE

(75) Inventors: Markus Proschko, Baudenbach (DE); Bodo Rorig, Weisendorf (DE)

(73) Assignee: Ina-Schaeffler KG, Herzogenaurach (DE)

( * ) Notice: Subject to any disclaimer, the term of this patent is extended or adjusted under 35 U.S.C. 154(b) by 20 days.

(21) Appl. No.: 10/548,680

(22) PCT Filed: Feb. 19, 2004

(86) PCT No.: PCT/EP2004/001566

§ 371 (c)(1),
(2), (4) Date: Sep. 8, 2005

(87) PCT Pub. No.: WO2004/083608

PCT Pub. Date: Sep. 30, 2004

(65) Prior Publication Data

US 2006/0157011 A1 Jul. 20, 2006

(30) Foreign Application Priority Data

Mar. 20, 2003 (DE) ..... 103 12 343

(51) Int. Cl.
*F01L 1/18* (2006.01)

(52) U.S. Cl. ..... 123/90.39; 123/90.44; 123/90.45; 74/559; 74/569

(58) Field of Classification Search ..... 123/90.39, 123/90.44
See application file for complete search history.

(56) References Cited

U.S. PATENT DOCUMENTS 5,490,486 A 2/1996 Diggs et al.
5,544,626 A 8/1996 Diggs et al.
5,653,198 A 8/1997 Diggs et al.
5,655,488 A 8/1997 Hampton et al.
5,678,459 A 10/1997 Motohashi et al.
5,960,755 A 10/1999 Diggs et al.
6,668,779 B2 * 12/2003 Hendriksma et al. .... 123/90.44
6,923,151 B2 * 8/2005 Kreuter ..... 123/90.16
2006/0260579 A1 * 11/2006 Proschko et al. ..... 123/90.41

FOREIGN PATENT DOCUMENTS

DE 2753197 A 6/1978
DE 4212844 A1 10/1993
DE 4321308 C1 7/1994
DE 4410288 C1 6/1995
DE 19606796 A1 11/1996
DE 19632444 C1 10/1997
DE 10211038 A 11/2002

* cited by examiner

*Primary Examiner*—Thomas Denion
*Assistant Examiner*—Kyle M. Riddle
(74) *Attorney, Agent, or Firm*—Lucas & Mercanti, LLP

(57) ABSTRACT

The invention relates to a rocker actuator (1) switchable to different cam travels. The inventive rocker actuator (1) comprises an external lever (2) which is arranged between the arms (3) and to which an internal lever (4) is pivotally connected. Said invention is characterised in that longitudinally movable connecting means (5) are arranged in the internal lever (4) at the level of the end (9) thereof and that said means are inward displaceable in the direction of the end (9) in such a way that they are meshed under the surface of the pusher dog (18) of the transversal element of the external lever (2)

17 Claims, 2 Drawing Sheets

Fig. 1
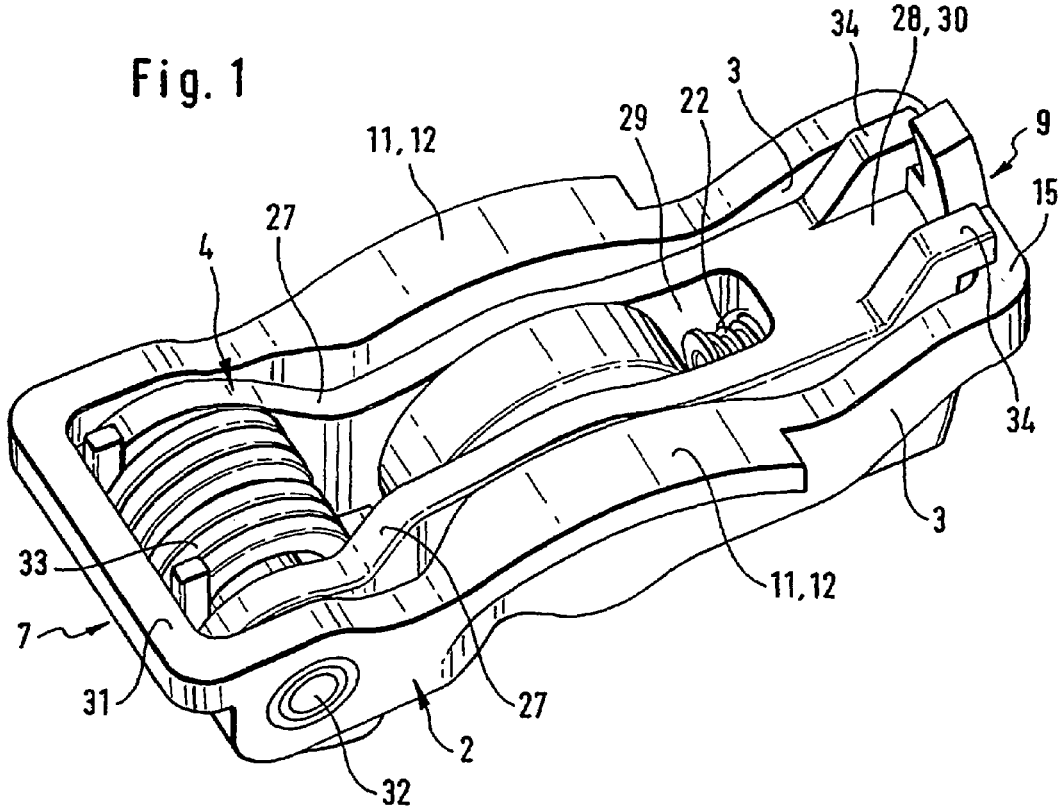
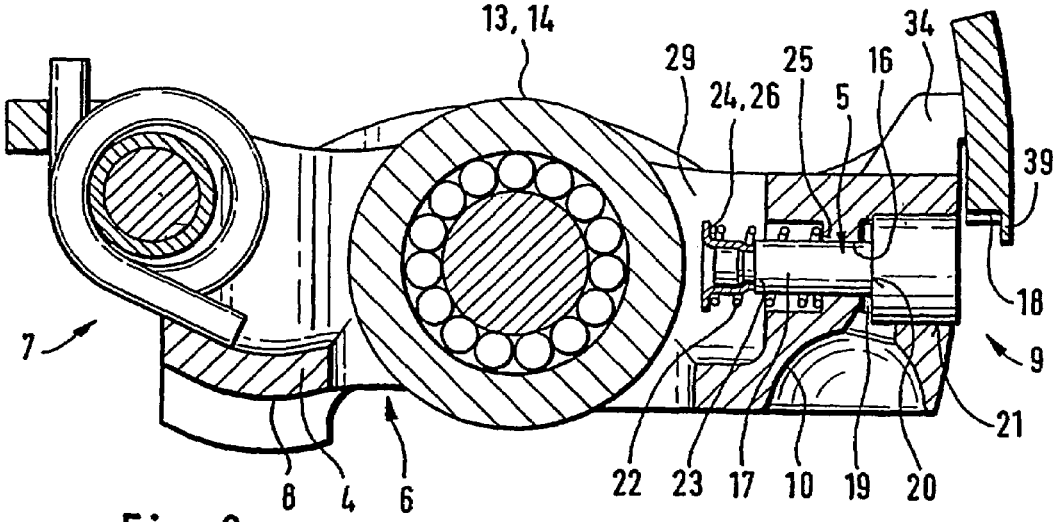
Fig. 2

Fig. 3
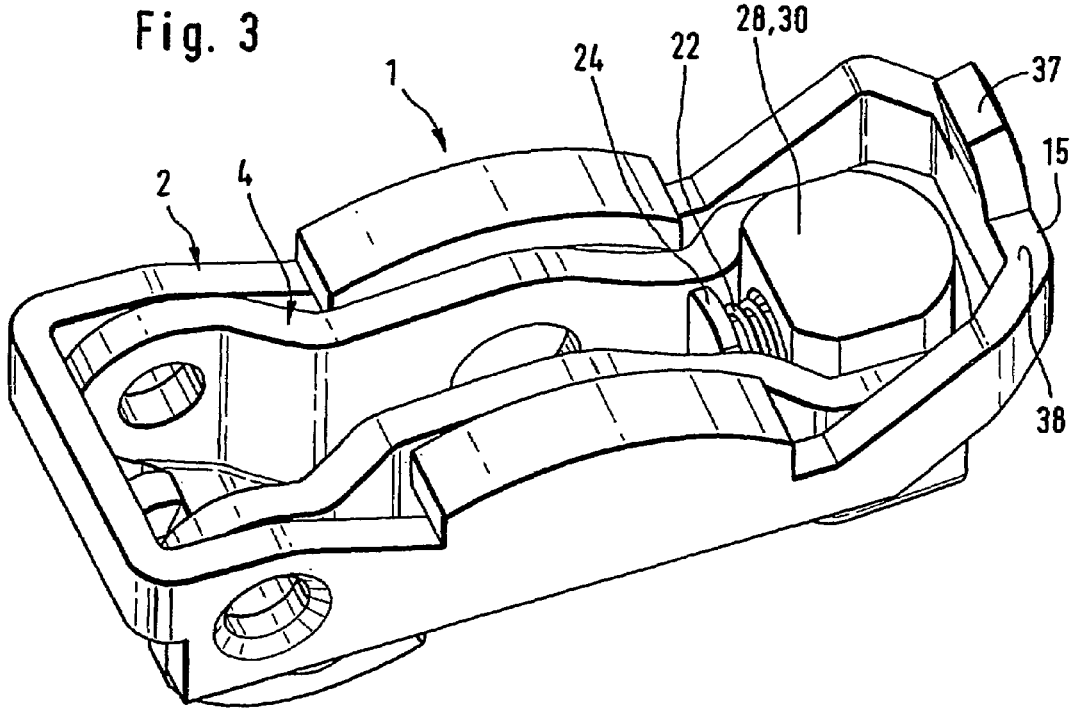
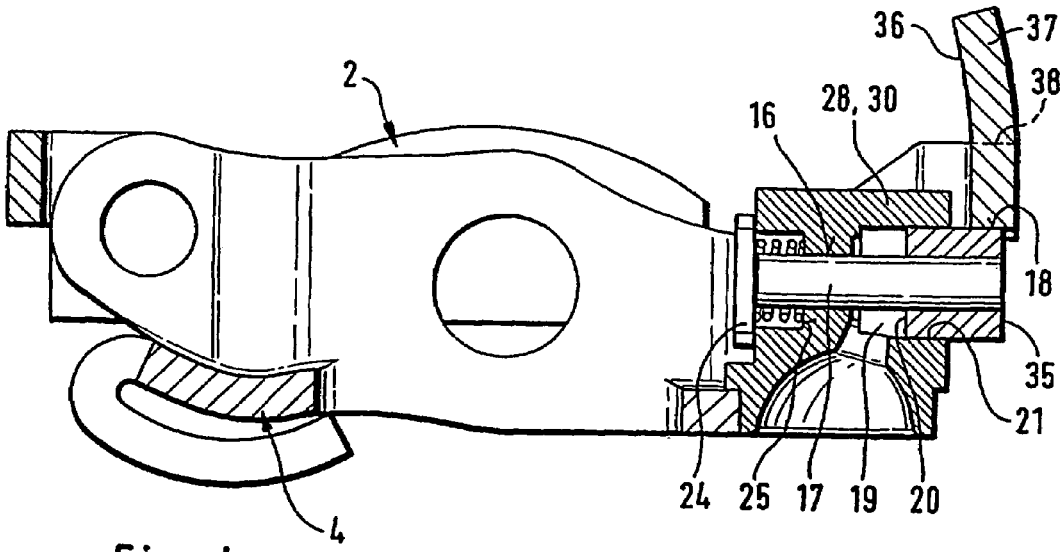
Fig. 4

SWITCHABLE FINGER LEVER OF A VALVE TRAIN OF AN INTERNAL COMBUSTION ENGINE

FIELD OF THE INVENTION

The invention concerns a finger lever of a valve train of an internal combustion engine, said finger lever being switchable to different lifts for at least one gas exchange valve and comprising an outer lever and an inner lever arranged between arms of the outer lever, said outer and inner levers being capable of pivoting relative to each other and of being coupled to each other by a coupling element, so that, in a coupled state, a high valve lift and in an uncoupled state, a low or zero valve lift is generated, a support for a gas exchange valve being arranged on one end of an underside of the finger lever, and a complementary surface for a support element being arranged on a further end of the underside of the finger lever, an upper side of the outer lever comprising at least one running contact surface for a high lift cam and an upper side of the inner lever comprising a running contact surface for a low or zero lift cam.

BACKGROUND OF THE INVENTION

A finger lever of the pre-cited type is known from DE-OS 27 53 197. The coupling element of this finger lever is a latch which engages under the inner lever and requires a complex linkage mechanism for its displacement. Disadvantageously, the latch increases the overall height of the switchable finger lever. At the same time, the external activation through the linkage is likewise relatively complex.

In a further switchable lever arrangement disclosed in DE 102 11 038 A1, coupling is achieved through a slide arranged in the outer lever. This slide can be displaced through externally arranged electromagnetic means. Here, too, it is clear that the external activation of the slide unnecessarily increases the design space requirement of the switchable finger lever in the region of the cylinder head. This finger lever thus also has a disadvantageously large overall length. It must be noted further that, due to the relatively short inner lever, a coupling of this to the outer lever would result in relatively large forces and thus also in relatively high component loading in the coupling region.

OBJECTS OF THE INVENTION

It is an object of the invention to provide a finger lever of the pre-cited type in which the aforesaid drawbacks are eliminated through simple measures.

This and other objects and advantages of the invention will become obvious from the following detailed description.

SUMMARY OF THE INVENTION

The invention achieves the above objects by the fact that the arms of the outer lever are connected in a region of the further end by a crossbar, a slide constituting the coupling element being arranged for sliding in a longitudinal bore extending within the inner lever above the complementary surface or in a region of the complementary surface, for coupling the inner and outer levers, the slide can be displaced toward the further end partially out of the longitudinal bore so as to engage an entraining surface configured as one of an underside of the crossbar or a bore of the crossbar, and, in a region of the one end, the inner lever is pivotally connected to the arms of the outer lever.

In a switchable finger lever with this configuration, the aforesaid drawbacks are eliminated. The overall design of the finger lever is very compact, so that no greater problems are to be expected in the case of a subsequent installation in otherwise ready-manufactured cylinder heads for non-switchable valve trains. Due to the fact that the coupling element (slide) with its pressure chamber is situated directly above the complementary surface for the support element, only very short hydraulic passages are required. The hydraulic medium is routed quasi directly from the complementary surface into the pressure chamber. It is also observed that, due to the favorable lever ratios in the coupling region, only a relatively low component loading can be expected.

Although, as described above, the slide is intended to be displaced longitudinally outwards for coupling, it is also conceivable to realize coupling through an inwards displacement of the slide. For achieving coupling, the slide engages, in a simple manner, preferably an underside of a crossbar of the outer lever situated in this region. It is, however, also conceivable to provide an appropriate recess for the slide in the crossbar.

For limiting the coupling movement of the slide, end stops for the slide can be arranged opposite the slide on the crossbar. These end stops may be configured, for example, in the form of lug-shaped extensions or stops of any known type on the underside of the crossbar. If the coupling surface in the crossbar is configured as a bore or the like, this may be provided with a stop. One possibility of realizing such a stop is to configure the bore as a stepped bore.

It is particularly advantageous if the slide is displaced only in one direction of displacement by the pressure of the hydraulic medium and, in the other direction, by the force of a spring means such as a coil compression spring. However, it is also conceivable to displace the slide in both directions by a hydraulic medium or, at least in one direction, by the force of another servo means such as, for instance, an electromagnet, a magnet or the like.

According to a further proposition of the invention, the levers are made of a light-weight material such as sheet metal. This has a favorable effect on the total mass of the finger lever as also on the manufacturing costs. However, it is also conceivable to make the finger lever by a casting method.

To minimize the complexity of fabrication, particularly in the case of a sheet metal configuration, the longitudinal bore for the slide can be provided in a separate insert that can be connected to the inner lever by a method with which the person skilled in the art is familiar, for example, welding, caulking, pressing-in or the like.

The fact that the entraining surface of the slide is displaced towards a hollow space of the inner lever for uncoupling, is a further measure for obtaining a compact finger lever. This hollow space is naturally large enough to ensure that, in the uncoupled state, no contact takes place within the inner lever between the entraining surface and a running contact surface, preferably configured in the form of a roller, for a cam.

According to a further advantageous feature of the invention, the slide can be made in one piece with its entraining surface although it is also conceivable to configure the entraining surface in the form of a separate spring cap or the like. Such a spring cap can be subsequently connected to an end of the slide, for example, by clipping it on.

In place of the aforesaid coil compression spring for the slide, it is also possible to use other pressure-exerting means such as disk springs, flat coil springs etc. As already mentioned, it is also conceivable to use magnetic means.

According to another feature of the invention, in the region of the support for the gas exchange valve, the outer lever is likewise connected through a crossbar. Thus, as seen in a top view, the outer lever forms a rectangular profile that has proved itself to be particularly rigid. However, an O-shaped profile of the outer lever is also conceivable.

According to another proposition of the invention relating to a simple connection of the outer lever to the inner lever, an axle extends through the inner lever in the region of the support for the gas exchange valve, and ends of the axle extend in the arms of the outer lever.

According to a further feature of the invention, the axle is surrounded by a torsion leg spring acting as a lost motion spring for the outer lever. However, it is also conceivable to use compression springs in this region.

A good compromise offered by the invention with a view to manufacturing costs and design complexity is to configure only the running contact surface in the inner lever as a roller and to make the running contact surfaces of the outer lever as sliding surfaces.

To obtain an exact alignment of the slide in the inner lever to the entraining surface on the underside of the associated crossbar of the outer lever, the invention proposes special vertical stops. These can extend from an upper side of the inner lever over the crossbar. Thus, to establish an exactly aligned connection, the outer lever comes to abut out of its uncoupled state against the vertical stop that is configured as a bridge member. The lash in the coupling region can thus be exactly defined. This measure can be seen at the same time as a securing means for transportation.

According to a further proposition of the invention, a lug-like extension extends in the region of the slide from an upper side of the crossbar. This extension prevents an undesired outward travel of the slide over the upper side of the crossbar during the uncoupling movement of the outer lever.

The invention will now be described more closely with reference to the appended drawing.

BRIEF DESCRIPTION OF THE DRAWING

FIG. 1 is a three-dimensional view of a finger lever of the invention,

FIG. 2 shows a longitudinal section through the finger lever of FIG. 1, taken along its central longitudinal axis, FIG. 3 is a three-dimensional view of another embodiment of the finger lever of the invention, FIG. 4 shows a longitudinal section through the finger lever of FIG. 3, taken along its central longitudinal axis.

DETAILED DESCRIPTION OF THE DRAWING

The figures disclose a finger lever 1 that can be switched to different cam lifts. The finger lever 1 comprises an outer lever 2 that is connected at one end 9 through a crossbar 15. An inner lever 4 is situated between arms 3 of the outer lever 2 and is articulated on the outer lever 2 in the region of a further end 7. The articulation is realized in that the inner lever 4 is mounted on an axle 32 whose outer axial ends are seated in bores of the arms 3 of the outer lever 2.

The lost motion spring 33 is a torsion leg spring that surrounds the axle 32 within the inner lever 4. In the uncoupled state of the outer lever 2 from the inner lever 4, this spring imparts, through its legs that need no further specification here, a re-setting motion to the outer lever 2.

Arranged approximately in a central region on the upper side 11 of each arm 3 of the outer lever 2 is a running contact surface 12 for a high lift cam. This running contact surface 12 is configured as a sliding surface. The inner lever 4, in contrast, comprises in its central region in a portion of its upper side 13, a running contact surface 14 for a low lift cam. This running contact surface 14 is configured in the present embodiment as a rotating roller. It can be seen further that, in the region of the end 7, the outer lever 2 is closed by a crossbar 31, so that, as a whole, as seen in a top view, the outer lever 2 forms a rectangular profile.

The inner lever 4 comprises on an underside 6 (see FIG. 2) in the region of the end 7, a support 8 for a gas exchange valve. On the opposite end 9, a cup-shaped complementary surface 10 is formed in the underside 6 of the inner lever 4.

Through this complementary surface 10, the inner lever 4, and thus also the entire finger lever 1, is seated on the head of a support element, not illustrated. It can also be seen that the complementary surface 10 is intersected almost directly by a pressure chamber 19 situated in front of a piston face 20 of a slide 17 that constitutes the coupling element 5. This will be discussed in more detail below.

As disclosed in FIGS. 2 and 4, the longitudinal bore 16 extends in length direction in the inner lever 4, preferably in a transverse portion 28 configured as a separate insert 30. The slide 17 shown in FIG. 2 has a multi-piece configuration. In the region of its inner end 23, the slide 17 comprises an entraining surface 24 configured as a spring cap 26 for one end of a spring 22 configured as a coil compression spring. This spring cap 26 can be coupled to the end 23, for instance, by a simple snap connection. At the other end, the spring 22 is supported on a support 25 of the longitudinal bore 16.

As shown in FIG. 4, the entraining surface 24 may also be formed integrally on the slide 17. According to this figure, the slide 17 has a separate sleeve that is fixed thereon in the region of the end 9. In the present embodiment, an inner annular end of this sleeve forms the piston face 20 in the pressure chamber 19. FIG. 4 further shows that the longitudinal bore 16 has a stepped configuration. Alternatively, it is possible to make this as a continuous bore and create the shoulder required for forming the support 25 and the pressure chamber 19 by means of a separate bushing.

As a person skilled in the art will further see from FIGS. 2 and 4, the pressure chamber 19 intersects the complementary surface 10 quasi directly. In this way, the pressure medium can be routed from the head of the support element directly into the pressure chamber 19 without diversions and without special passages that increase the complexity of fabrication.

FIG. 2 shows the uncoupled state of the outer lever 2 from the inner lever 4. For coupling the levers 2, 4 to each other during a base circle phase of the loading cam, the pressure chamber 19 is supplied with pressure medium from the head of the support element such that the slide 17 is pushed axially outwards partially out of its bore 16. The slide 17 then engages under an entraining surface 18 of the crossbar 15 of the outer lever 2. As a result, the finger lever 1 follows the lift of the high lift cams that load the arms 3 of the outer lever 2. A re-setting of the slide 17 with decreasing hydraulic medium pressure is effected in a manner known to the person skilled in the art by the force of the spring element 22.

As can be seen in FIG. 1, according to a further proposition of the invention, two bridge members 34 that lengthen the arms 27 of the inner lever 4 are arranged on the upper side 13 of the inner lever 4 in the region of the end 9. These bridge members 34 extend over the crossbar 15 of the outer lever 2. Thus, for the return pivoting movement of the outer lever 2 out of the uncoupled state, the position of the outer lever 2 relative to the inner lever 4 is excellently defined. If necessary, the slide 17 can be made to engage the entraining surface 18 of the outer lever 2 at an exactly defined point.

As best seen in FIG. 4, a lug-like extension 37 projects from an upper side 38 of the crossbar 15. During a downward pivoting movement of the outer lever 2, an outer end face 35 of the slide 17 is always situated opposite an inner side 36 of the extension 37 or of the crossbar 15, as the case may be. An undesired outward travel of the slide 17 over the upper side 38 of the crossbar is thus prevented.

FIG. 2 further shows that an extension 39 is arranged on the entraining surface 18 of the crossbar 15. This extension 39 serves to limit the outward travel of the slide 17.

A particular advantage offered by the invention is that component tolerances in the region of coupling are relatively small while, at the same time, the coupling mechanism possesses an excellent rigidity. Furthermore, the slide 17 is relatively simple to manufacture and mount.

The invention claimed is:

1. A finger lever of a valve train of an internal combustion engine, said finger lever being switchable to different lifts for at least one gas exchange valve and comprising an outer lever and an inner lever arranged between arms of the outer lever, said outer and inner levers being capable of pivoting relative to each other and of being coupled to each other by a coupling element, so that, in a coupled state, a high valve lift and in an uncoupled state, a low or zero valve lift is generated, a support for a gas exchange valve being arranged on one end of an underside of the finger lever, and a complementary surface for a support element being arranged on a further end of the underside of the finger lever, an upper side of the outer lever comprising at least one running contact surface for a high lift cam and an upper side of the inner lever comprising a running contact surface for a low or zero lift cam, wherein the arms of the outer lever are connected in a region of the further end by a crossbar, a slide constituting the coupling element being arranged for sliding in a longitudinal bore extending within the inner lever above the complementary surface or in a region of the complementary surface, for coupling the inner and outer levers, the slide can be displaced toward the further end partially out of the longitudinal bore so as to engage an entraining surface configured as one of an underside of the crossbar or a bore of the crossbar, and, in a region of the one end, the inner lever is pivotally connected to the arms of the outer lever.

2. A finger lever of claim 1, wherein the longitudinal bore at least almost intersects the complementary surface configured in form of a cup-shaped cavity for the support element, a pressure chamber for hydraulic medium being formed within the longitudinal bore, which pressure chamber can be supplied in a region of intersection with pressure medium from the head of the support element, the slide comprises a piston face that is configured as an annular enlargement and extends in a diameter enlargement of the longitudinal bore, and the pressure chamber is defined by the piston face and the diameter enlargement.

3. A finger lever of claim 2, wherein the slide can be displaced in coupling direction through a force of the hydraulic medium.

4. A finger lever of claim 3, wherein a displacement of the slide in uncoupling direction is effected through a force of a spring element, typically a coil compression spring that partially surrounds an axially inner end of the slide and acts at this axially inner end on an inner entraining surface of the slide, the spring element being supported at a further end on a support of the inner lever, typically on an annular shoulder of the longitudinal bore.

5. A finger lever of claim 4, wherein the entraining surface of the slide is made integrally on the slide.

6. A finger lever of claim 4, wherein the entraining surface of the slide is made as a separate part, typically a spring cap that is connected to the axially inner end of the slide by a fixing method chosen from the group consisting of pressing-on, clipping-on or gluing.

7. A finger lever of claim 4, wherein the inner lever comprises two arms that extend approximately parallel to the arms of the outer lever, the longitudinal bore being arranged in a transverse portion that connects the arms of the inner lever to each other, the entraining surface of the spring element and the slide together with the spring element projects partially, at least in an uncoupled state, into a hollow space situated between the arms of the inner lever.

8. A finger lever of claim 1, wherein the inner lever comprises two arms that extend approximately parallel to the arms of the outer lever, the longitudinal bore being arranged in a transverse portion that connects the arms of the inner lever to each other, and this transverse portion is configured as a separate insert and fixed in the inner lever.

9. A finger lever of claim 1, wherein the arms of the outer lever are connected to each other through a crossbar in a region of the one end comprising the support.

10. A finger lever of claim 1, wherein, for enabling a pivoting connection between the inner and the outer lever, an axle is arranged to extend through the inner lever and axially outer ends of the axle extend in the arms of the outer lever, within the inner lever, the axle is surrounded by a torsion leg spring that serves as a lost motion spring for the outer lever.

11. A finger lever of claim 1, wherein the running contact surface of the inner lever is configured as a rotating roller and the at least one running contact surface of the outer lever is configured as a sliding surface.

12. A finger lever of claim 1, wherein at least one of the inner and the outer lever is made at least substantially of a light-weight material.

13. A finger lever of claim 12, wherein the light weight material is chosen from the group consisting of a deep drawn sheet metal, a sheet metal capable of being deep drawn, a plastic and a fiber reinforced plastic.

14. A finger lever of claim 1, wherein a vertical stop means for the outer lever is arranged in a region of the further end of the finger lever for establishing an aligned connection of the slide in the longitudinal bore of the inner lever to the entraining surface of the outer lever.

15. A finger lever of claim 14, wherein the vertical stop means comprises at least one bridge member that starts from the upper side of the inner lever and extends over the crossbar in a region of the further end of the finger lever.

16. A finger lever of claim 1, wherein, at least in a region of the slide, the crossbar has a height such that an inner side of the crossbar is situated opposite an outer end face of the slide throughout a complete uncoupling travel of the outer lever from the inner lever.

17. A finger lever of claim 16, wherein, in a region of the slide, the inner side of the crossbar is configured in form of a lug-like extension on an upper side of the crossbar.

* * * * *